US008813301B2

(12) United States Patent
Bunting

(10) Patent No.: US 8,813,301 B2
(45) Date of Patent: Aug. 26, 2014

(54) CONDUCTIVE BRUSH FOR CLEANING METALS

(75) Inventor: William Paul Bunting, Winmalee (AU)

(73) Assignee: Kezza Products PTY Limited, Emu Plains NSW (AU)

( * ) Notice: Subject to any disclaimer, the term of this patent is extended or adjusted under 35 U.S.C. 154(b) by 273 days.

(21) Appl. No.: 13/147,433

(22) PCT Filed: Jan. 29, 2010

(86) PCT No.: PCT/AU2010/000085
§ 371 (c)(1), (2), (4) Date: Sep. 21, 2011

(87) PCT Pub. No.: WO2010/085849
PCT Pub. Date: Aug. 5, 2010

(65) Prior Publication Data

US 2012/0000026 A1 Jan. 5, 2012

(30) Foreign Application Priority Data

Feb. 2, 2009 (AU) ..... 2009900354

(51) Int. Cl.
*A46B 9/10* (2006.01)
*A46B 15/00* (2006.01)

(52) U.S. Cl.
USPC ..... 15/169; 15/184; 15/197; 15/200; 29/81.12; 29/81.17

(58) Field of Classification Search
CPC ..... B08B 1/00; B08B 1/002; B08B 2220/00; B08B 2240/00; A46B 9/08; A46B 9/10; A46B 15/00; A46B 2200/00
USPC ..... 15/168–170, 184, 197, 200; 29/81.11, 29/81.12, 81.17
See application file for complete search history.

(56) References Cited

U.S. PATENT DOCUMENTS

| | | | | | |
|---|---|---|---|---|---|
| 783,937 | A | * | 2/1905 | Edwards et al. | 15/197 |
| 1,382,042 | A | * | 6/1921 | Wright | 15/169 |
| 1,629,481 | A | * | 5/1927 | Davidson | 15/197 |
| 1,776,443 | A | * | 9/1930 | Martin | 15/111 |
| 3,106,738 | A | * | 10/1963 | Bohne | 15/184 |
| 5,010,632 | A | * | 4/1991 | Gardner | 29/81.14 |

FOREIGN PATENT DOCUMENTS

WO 2005089968 A1 9/2005

OTHER PUBLICATIONS

Tuthill, Arthur H. et al, "Specifying Stainless Steel Surface Treatments," Stainless Steel World, Jun. 13, 2003.

* cited by examiner

*Primary Examiner* — Mark Spisich
(74) *Attorney, Agent, or Firm* — Janet Sleath; Speckman Law Group PLLC

(57) ABSTRACT

A conductive weld brush (10) consists of a conductive receptacle (12), a bundle of conductive fibers (13) which are anchored by their inner end within the conductive receptacle (12) and a slidable support sleeve (20) which has a first end portion (21) which receives the conductive receptacle (12) and a shaped second end portion (22) which surrounds and shapes the fiber bundle (13).

8 Claims, 2 Drawing Sheets

CONDUCTIVE BRUSH FOR CLEANING METALS

TECHNICAL FIELD

This invention relates to the cleaning of stainless steel and other metals subsequent to welding operations. For the sake of convenience, the invention will be described in relation to welded stainless steel surfaces but it is to be understood that the invention is not limited thereto as it may be applied to other welded surfaces.

BACKGROUND ART

In the course of welding stainless steel surfaces, chromium is depleted and thereby exposing iron causing localised discolouration which must be removed to restore the polished appearance to the stainless steel. Metallic oxides in the form of scale can also form on the surface during the welding process and these need to be cleaned away or otherwise removed.

Surface staining and weld scale on stainless steel parts can be removed using a pickling gel of toxic acids including hydrofluoric and nitric acids. This prior art method requires a significant amount of time and occupational health and safety risks result.

It is also known to use electrically activated stainless steel weld cleaning devices which utilise a non-conductive fabric sock that covers a solid or wire electrode. The sock acts as a separator between the electrode and the work piece as well as a reservoir for the acidic electrolyte cleaning solution.

The sock is saturated with the cleaning solution which provides a short electrically conductive path between the electrode and the work piece. The cleaning solution is heated by the passage of electrical current through it and becomes more chemically active thereby cleaning the metal surface.

One disadvantage with these prior art devices is that the fabric socks tend to dry out and then burn through with the heat of the process. Another disadvantage is that the electrode is essentially a rigid shape which cannot conform to the many odd shapes encountered in stainless steel fabricated constructions.

Another approach is to use a conductive brush which consists of a conductive receptacle from which extends a bundle of conductive filaments or fibres. However, such conductive brushes perform poorly as a brush bristle because the fibres tend to flop on their sides—particularly when wet with electrolyte—rather than presenting erect fibre ends as the working contact point.

Electricity travels along the shortest path so that the electric current will flow through the side of a fibre part way along its length where the fibre comes in contact with the metal surface being cleaned. This causes two problems—one is that the heat caused by the flow of electrical current through the side wall of the fibre tends to cut the fibre at the contact point. The second problem is that whereas this flow of electric current performs the desired effect of heating the immersion electrolyte thereby cleaning the metal surface, accurate control of the cleaning process is reduced due to the broad spread of the fibres. When working in corners, the electric current passes to the nearest contact point and thus the current reaching the full depth of the corner is significantly reduced. It is therefore difficult to clean properly two faced corners with three faced corners being even more difficult.

DISCLOSURE OF INVENTION

According to one aspect of the invention there is provided a conductive weld brush comprising a conductive receptacle having a first end and a second end, a bundle of conductive fibres anchored by one end to the first end of the receptacle with the remainder of the bundle extending from the receptacle and a slidable support sleeve having an inner end slidable along the receptacle, the sleeve having a shaped outer end portion movable along the bundle of fibres.

BEST MODE FOR CARRYING OUT THE INVENTION

Figure 1:
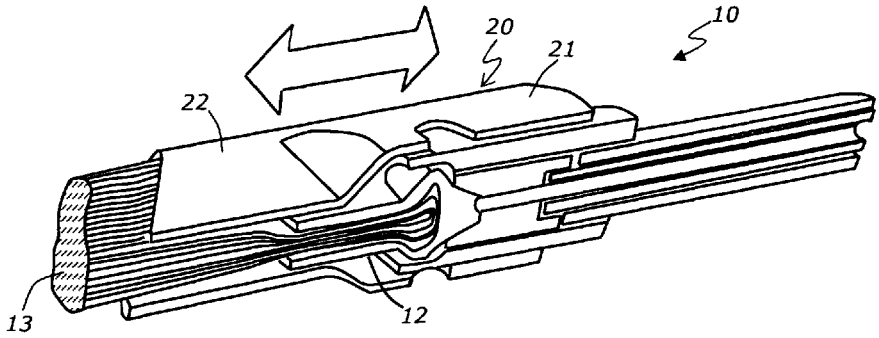
FIG. 1 is a cutaway perspective view of a conductive weld brush according to one embodiment of the invention.
Figure 2:
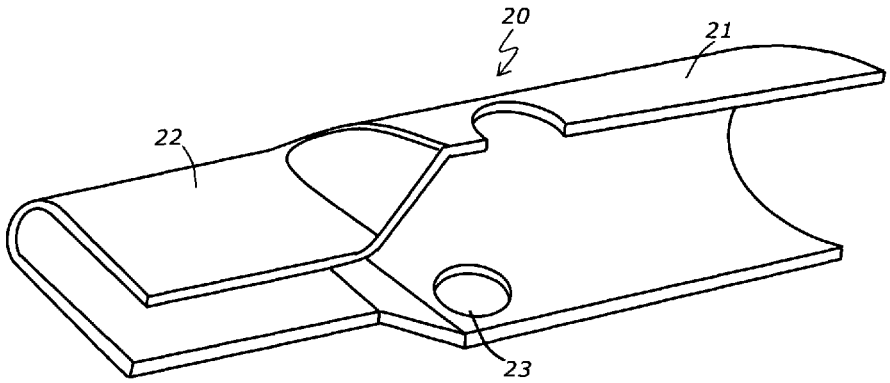
FIG. 2 is a perspective view of the slidable support sleeve shown in FIG. 1.
Figure 3:
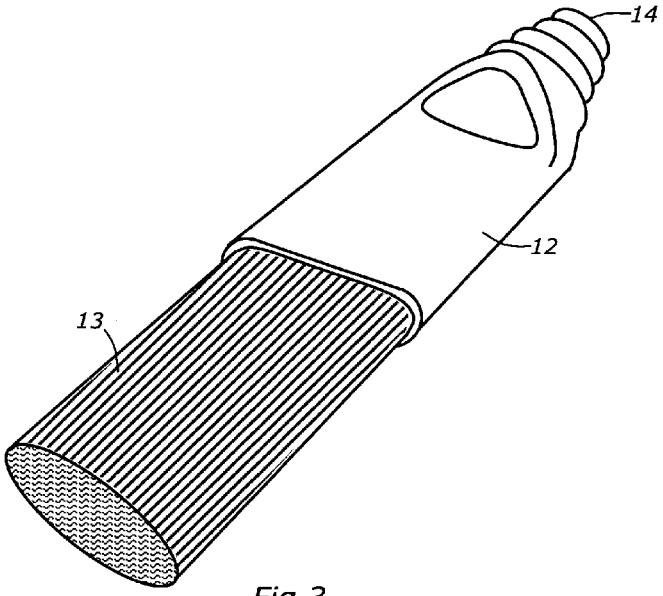
FIG. 3 is a perspective view of the brush assembly shown in FIG. 1.
Figure 4:
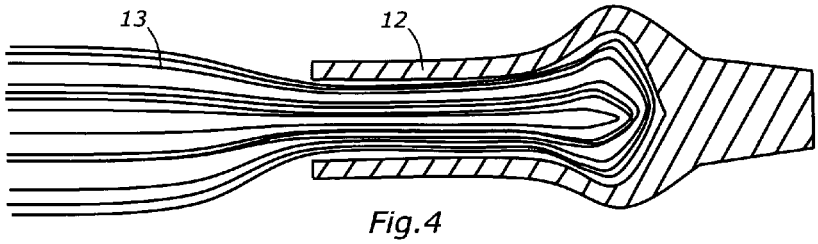
FIG. 4 is a cross sectional view of the brush assembly shown in FIG. 3.
Figure 5:
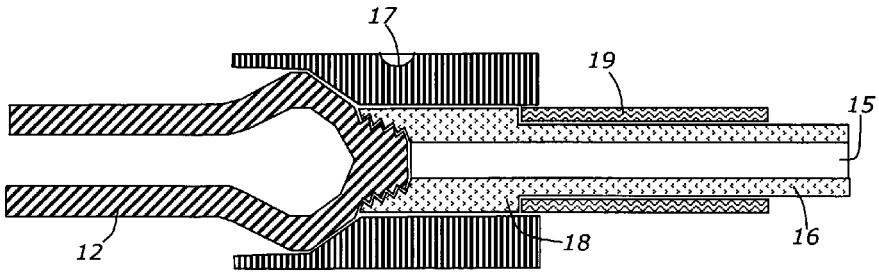
FIG. 5 is a cross sectional view of the conductive brush shown in FIG. 1 without the slidable support sleeve and without the fibres.

The conductive weld brush 10 shown in the drawings includes a conductive receptacle 12 and a bundle of conductive fibres 13 which are anchored by their inner end with conductive receptacle 12. As can be seen in FIG. 3, the conductive receptacle 12 is of flattened configuration and has a connection 14 at the non-fibre end which is connected to conductor 15 within a wand 16. A tip insulator 17 surrounds the connection 14, the end portion of the brush 12 and the socket 18 of the wand 16. An insulator 19 surrounds the wand 16 and its inner end is located within the tip insulator 17.

The conductive brush 10 also includes a slidable support sleeve 20 which has a first end portion 21 which receives the conductive receptacle 12 and a shaped second end portion 22 which surrounds and shapes the fibre bundle 13. The support sleeve 20 has acid entry holes 23 so that the brush 10 may be dipped to apply the acid and the end of the fibre containing portion 22 may be profiled to suit any particular application.

As will be apparent from the foregoing description, the fibre bundle can be held in the desired shape whilst cleaning is being performed. This is made possible by the slidable support sleeve which can be variously shaped at its outer end and whose cross section fits neatly over the fibre bundle in a manner that allows it to be adjusted along the fibre length as the fibres deteriorate in use.

The conductive brush of the invention has improved performance which is achieved through the concentration of the energy transfer and by presenting the fibre ends to the metal surface and improved electric arc process between the fibre ends and the metal surface serve to help break up tough metal oxides that can form on some welds.

The preferred shape of the receptacle 12 is a round-ended rectangle which gives a flat brush of uniform sectional thickness.

The slidable support sleeve can be formed from any one of the variety of materials such as teflon, ceramic, or metal. The support sleeve 20 is shaped at one end to slidingly fit over the fibre brush bundle 13 and the receptacle 12 with some clearance for a portion of the sleeve's length. The rest of the sleeve is formed to be a sliding fit over the brush insulator for whatever cross sectional shape the brush insulator takes for a particular design.

In a modification of the invention, the cleaning liquid could be introduced through the wand stem 16 into the interior of the receptacle 12.

Industrial Applicability

The conductive weld brush of the invention has application to the cleaning of welded stainless steel and other metal surfaces.

The invention claimed is:

1. A conductive weld brush comprising:

a conductive receptacle having a first end and a second end;

a bundle of conductive fibres anchored by one end to the first end of the receptacle with the remainder of the bundle extending from the receptacle;

a slidable support sleeve having an inner end slidable along the receptacle, the sleeve having a shaped outer end portion movable along the bundle of fibres; and an electrical conductor connected to the conductive receptacle, the electrical conductor being in electrical contact with the conductive receptacle, wherein the cross-sectional shape of the outer end portion of the slidable sleeve is a round ended rectangle so as to form the fibre bundle into a flat brush of uniform cross section.

2. A conductive weld brush comprising:

a conductive receptacle having a first end and a second end;

a bundle of conductive fibres anchored by one end to the first end of the receptacle with the remainder of the bundle extending from the receptacle;

a slidable support sleeve having an inner end portion slidable along the receptacle, the sleeve having a shaped outer end portion movable along the bundle of fibres; and an electrical conductor connected to the conductive receptacle, the electrical conductor being in electrical contact with the conductive receptacle, wherein the conductive receptacle is of similar shape to the inner end portion of the slidable sleeve and has an electrical connection at its second end used to connect the electrical conductor to the conductive receptacle, and wherein the electrical conductor is contained within a wand of the weld brush.

3. A conductive weld brush according to claim 2 wherein the slidable sleeve is formed from polytetrafluoroethylene (PTFE) or a ceramic material.

4. A conductive weld brush according to claim 2 wherein the slidable sleeve has openings through which cleaning liquid may be introduced into the fibre bundle.

5. A conductive weld brush according to claim 2 further including an insulator around the second end of the conductive receptacle and an inner end of the wand.

6. A conductive weld brush comprising:

a conductive receptacle having a first end and a second end;

a bundle of conductive fibres anchored by one end to the first end of the receptacle with the remainder of the bundle extending from the receptacle;

a slidable support sleeve having an inner end slidable along the receptacle, the sleeve having a shaped outer end portion movable along the bundle of fibres;

an electrical conductor connected to the conductive receptacle, the electrical conductor being in electrical contact with the conductive receptacle; and an insulator around the conductive receptacle in between the conductive receptacle and the slidable sleeve.

7. A conductive weld brush according to claim 6, wherein the slidable sleeve is formed from polytetrafluoroethylene (PTFE) or a ceramic material.

8. A conductive weld brush according to claim 6 wherein the slidable sleeve has openings through which cleaning liquid may be introduced into the fibre bundle.

* * * * *